US006091381A

United States Patent [19]

Uenuma

[11] Patent Number: 6,091,381

[45] Date of Patent: Jul. 18, 2000

[54] DISPLAY DEVICE

[75] Inventor: Mitsuo Uenuma, Mobara, Japan

[73] Assignee: Futaba Denshi Kogyo K.K., Mobara, Japan

[21] Appl. No.: 08/847,455

[22] Filed: Apr. 23, 1997

[51] Int. Cl.[7] ..... G09G 3/22

[52] U.S. Cl. ..... 345/74

[58] Field of Search ..... 345/55, 60, 63, 345/64, 74, 89

[56] References Cited

U.S. PATENT DOCUMENTS 5,663,742 9/1997 Hush ..... 345/74

5,847,515 12/1998 Lee et al. ..... 345/74

*Primary Examiner*—Matthew Luu

*Attorney, Agent, or Firm*—Oblon, Spivak, McClelland, Maier & Neustadt, P.C.

[57] ABSTRACT

A display device capable of realizing stepless gradation expression depending on a video signal inputted, to thereby highly improve quality of an image displayed. An FET element is arranged for each of cathode electrodes to permit a drain current obtained depending on a voltage of a video signal applied to a gate of each FET element to be fed to each cathode electrode. Also, a video signal correction circuit is arranged for providing the video signal applied to each FET element with characteristics reverse to gate/source voltage-drain current characteristics of the FET element. Such construction permits a cathode current to be controlled in a stepless manner depending on a level of the video signal, to thereby realize stepless gradation expression depending on the video signal, resulting in quality of an image displayed being extensively increased.

3 Claims, 7 Drawing Sheets

DISPLAY DEVICE

BACKGROUND OF THE INVENTION.

This invention relates to an image display device including scan electrodes arranged in a matrix-like manner, and more particularly to a display device which may be suitably realized in the form of an FED display device, an organic electroluminescence (hereinafter referred to as "EL") display device or the like.

When an electric field set to be about $10^9$ (V/m) is applied to a surface of a metal material or that of a semiconductor material, a tunnel effect occurs to permit electrons to pass through a barrier, resulting in the electrons being discharged to a vacuum even at a normal temperature. Such a phenomenon is referred to as "field emission" and a cathode constructed so as to emit electrons based on such a principle is referred to as "field emission cathode" (hereinafter also referred to as "FEC").

Recent development of semiconductor processing techniques permits a field emission cathode of the surface emission type to be constructed of an array of field emission cathode elements having a size as small as microns, so that an image display device (FED display device) having such field emission cathodes incorporated therein is currently subject to research and development.

Also, an organic EL display device which is another display device is likewise subject to research and development. The organic EL display device includes a luminous layer made of an organic compound while being based on an EL phenomenon wherein application of an electric field to a phosphor leads to luminescence of the phosphor.

In each of the image display device and organic EL display device, an improvement in quality of an image displayed requires to realize increased gradation expression. In order to control luminance of the display depending on an input video signal to realize satisfactory gradation expression, a system is employed wherein a signal which is subject to pulse width modulation (PWM) depending on the input video signal is used as a drive signal. Thus, a luminous time of each picture cell or pixel is controlled depending on the input video signal, resulting In gradation expression being carried out.

In general, pulse width modulation is attained by carrying out A/D conversion of an input video signal to obtain a digital data on the input video signal and detecting coincidence between the digital data and a value counted by a counter. In practice, the A/D conversion is restricted to a level as small as about 6 bits or the number of steps of gradation as small as 64 due to restriction of the number of wirings and a frequency of a clock for the counter. This renders realization of the number of steps of gradation as large as 256 or more at 8 bits highly difficult. Thus, the PWM system imposes restrictions to gradation expression, to thereby prevent the display from being provided with increased quality.

Also, a pulse amplitude modulation (PAM) system is proposed for the same purpose. It is adapted to execute gradation expression by modulating a drive voltage such as a voltage between a gate and a cathode (gate/cathode voltage) in the FED display device or a voltage between an anode and a cathode (anode/cathode voltage) in the organic EL display device. Unfortunately, the PAM system fails to accurately control gradation due to a variation in anode current leading edge point voltage on anode current characteristics (variation for every image cell pixel) in the FED display device or organic EL display device, temperature characteristics of a drive circuit, power loss or the like, to thereby fail to ensure increased display quality.

SUMMARY OF THE INVENTION

The present invention has been made in view of the foregoing disadvantage of the prior art.

Accordingly, it is an object of the present invention to provide a display device which Is capable of realizing stepless gradation expression depending on a video signal inputted, to thereby extensively increase quality of an image displayed.

In accordance with the present invention, a display device is provided. The display device includes an FED display section. The FED display section includes a plurality of cathode electrodes each formed into a stripe-like manner and including emitters for field emission of electrons, a plurality of gate electrodes formed In a stripe-like manner and arranged in a direction perpendicular to the cathode electrodes, and an anode electrode for capturing electrons emitted from the emitters, resulting in display pixels being defined in a matrix-like manner. Also, the display device includes a display drive circuit for driving the gate electrodes in order and driving the cathode electrodes depending on a video signal for every horizontal line, to thereby permit the FED display section to execute image display. The display drive circuit Includes an FET element arranged for each of the cathode electrodes and is so constructed that a drain current obtained depending on a voltage of the video signal applied to a gate of each of the FET elements may be fed in the form of a drive current to each of the cathode electrodes.

In a preferred embodiment of the present invention, the display device further includes a video signal correction circuit for providing the video signal applied to the FET elements with characteristics reverse to gate/source voltage-drain current characteristics of the FET elements.

In a preferred embodiment of the present invention, the video signal correction circuit corrects characteristics of the video signal applied to each of the FET elements with respect to non-linear characteristics of the FED display section as well.

Also, in accordance with the present invention, a display device is provided. The display device includes an organic EL display section including a plurality of cathode electrodes formed in a stripe-like manner and a plurality of anode electrodes formed in a strlpe-like manner and arranged in a direction perpendicular to the cathode electrodes, resulting in display pixels being defined in a matrix-like manner, and a display drive circuit for driving the anode electrodes in order and driving the cathode electrodes depending on a video signal for every horizontal line. to thereby permit the EL display section to execute image display. The display drive circuit includes an FET element arranged for each of the cathode electrodes and is so constructed that a drain current obtained depending on a voltage for the video signal applied to a gate of each of the FET elements may be fed in the form of a drive current to each of the cathode electrodes.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, a display device according to the present invention will be described hereinafter with reference to the accompanying drawings.

Referring first to FIGS. 1 to 5, an embodiment of a display device according to the present invention is illustrated, which is in the form of an FED display device.

Figure 2:
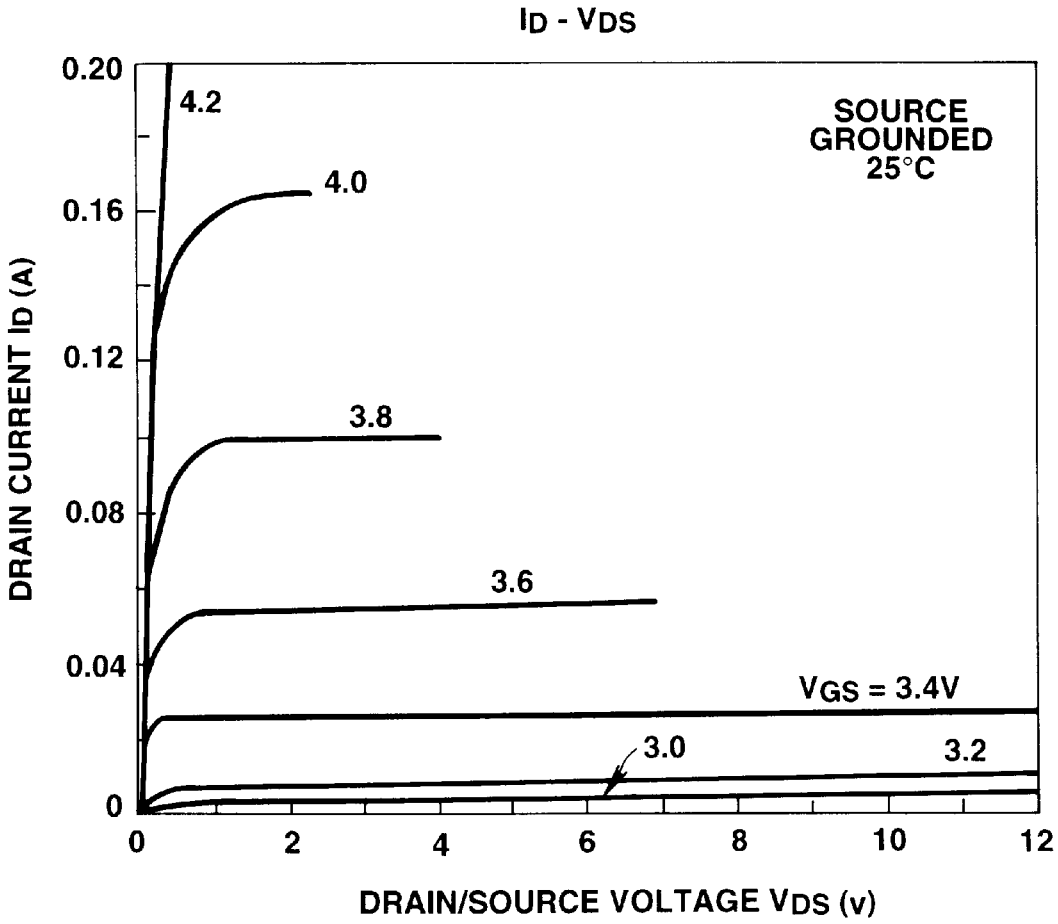
FIG. 2 is a graphical representation showing $V_{DS}$-$I_D$ characteristics of an FET.
Figure 3:
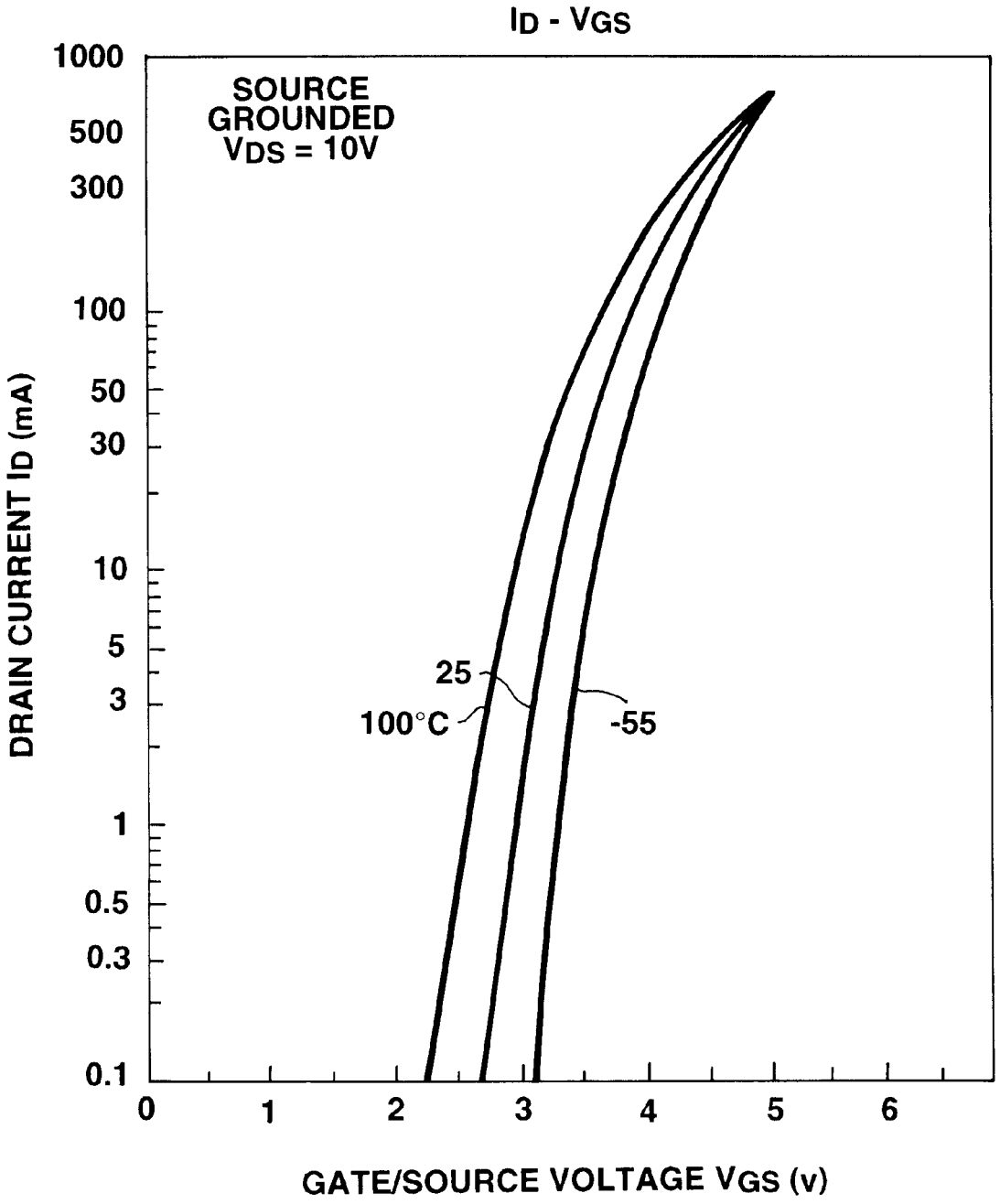
FIG. 3 is a graphical representation showing $V_{GS}$-$I_D$ characteristics of an FET.
Figure 4:
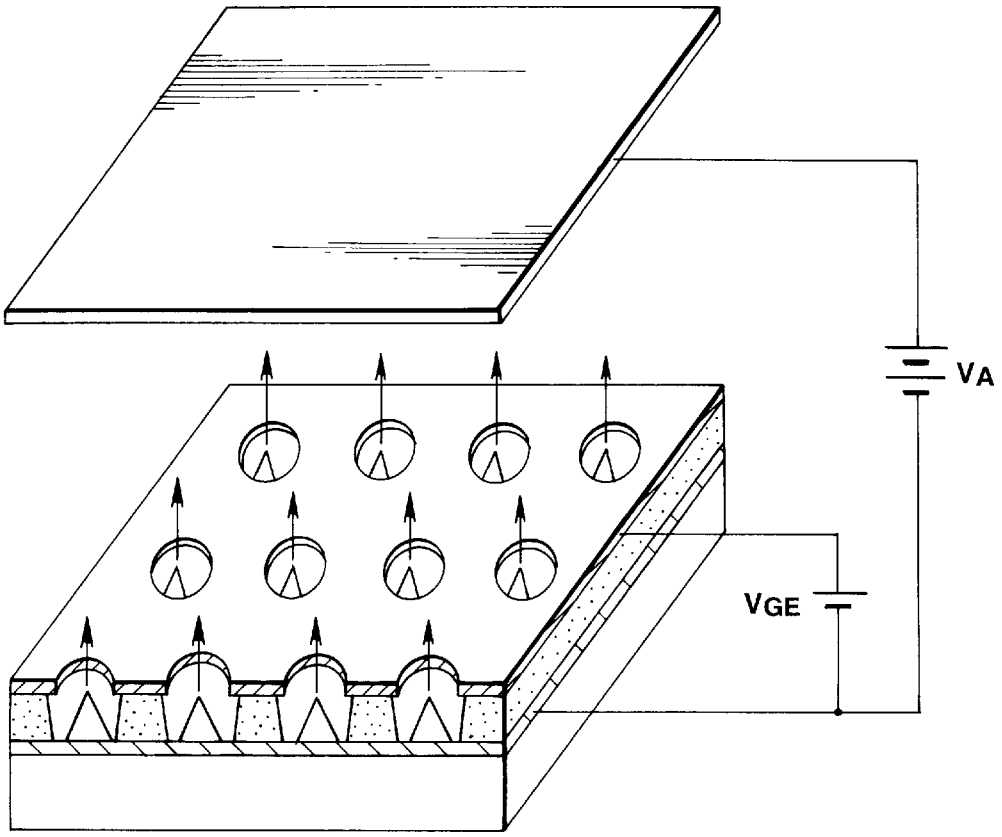
FIG. 4 is a schematic perspective view in section showing an FED.

Of FIGS. 1 to 5, FIG. 4 shows an FEC used for an FED display device of the illustrated embodiment, which is constructed into an FEC of the Spindt type by semiconductor processing techniques. The FEC, as shown in FIG. 4, includes a substrate K made of glass or the like, on which cathode electrodes C are formed of metal such as Al or the like by deposition. The cathode electrodes C each are provided thereon with emitters E, which are formed of metal such as Mo or the like into a conical shape.

The cathode electrodes C each are formed thereon with a silicon dioxide ($SiO_2$) film, on which a gate GT is arranged. Each of the gates GT and each of the $SiO_2$ films are formed with through-holes or apertures of a circular shape in a manner to commonly extend therethrough, in which the above-described conical emitters E are arranged in a manner to be exposed at a distal end thereof through the apertures of the gates GT.

The conical emitters E are arranged so as to be spaced from each other at pitches as small as 10 microns or less. This permits tens of thousands to hundreds of thousands of emitters E to be arranged on the substrate K.

Also, the FEC may be constructed so as to reduce a distance between the gate GT and the distal end of each of the emitters B to a level as small as less than a micron, so that application of a gate/emitter voltage $V_{GE}$ as low as tens of volts between each of the gates GT and the distal end of each of the emitters E (each of the cathode electrodes C) permits the emitter E to emit electrons. The electrons thus field-emitted are captured by an anode A which is arranged above the gate GT so as to be spaced therefrom and opposite to the gate GT and has a positive voltage $V_A$ applied thereto.

Figure 5:
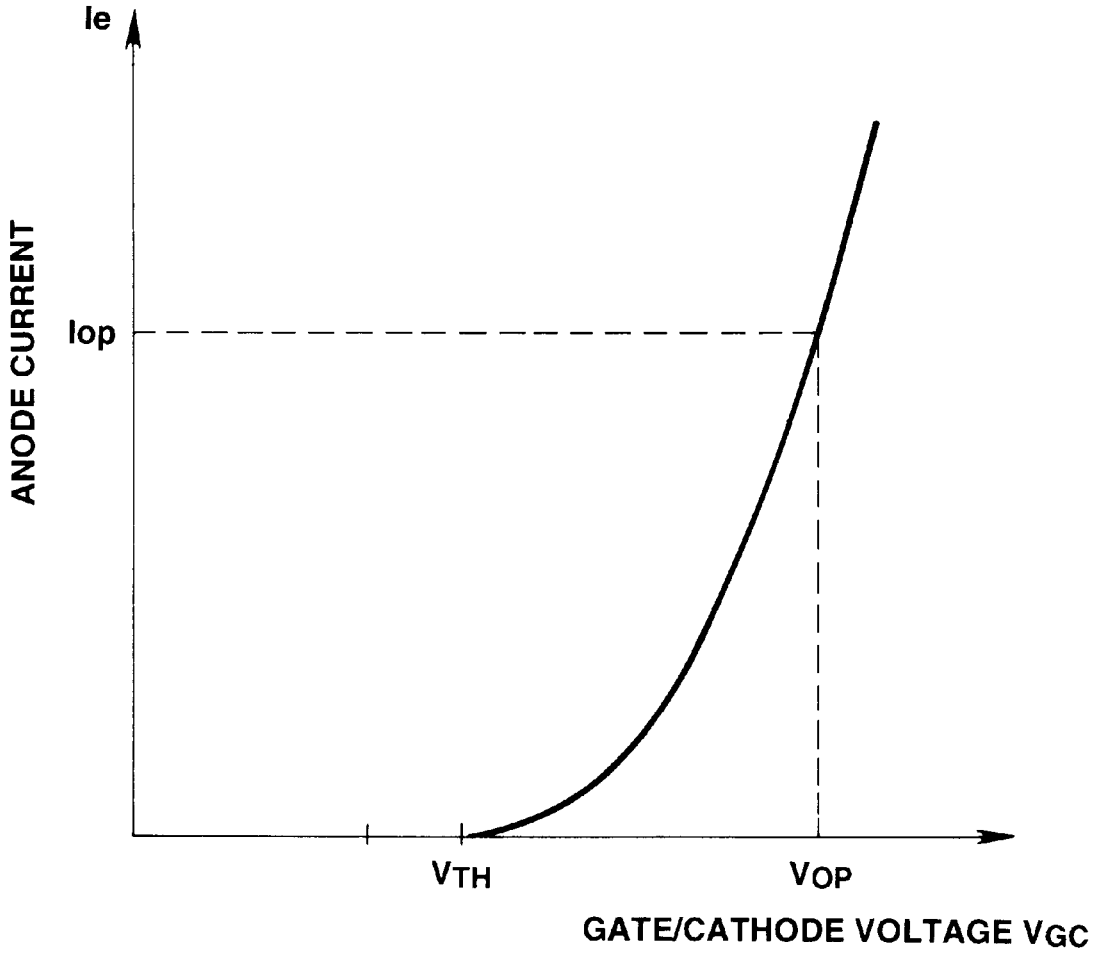
FIG. 5 is a graphical representation showing $V_{GC}$-$I_D$ characteristics of an FET.

The FEC thus constructed has such anode current Ie-gate/cathode voltage $V_{GC}$ characteristics as shown in FIG. 5. As shown in FIG. 5, a gradual increase in gate/cathode voltage $V_{GC}$ permits the anode current Ie to start to flow. The voltage $V_{GC}$ at which flowing of the current Ie starts is called a threshold voltage $V_{TH}$ so that an electric field between the gate and the cathode reaches a level as high as about $10_9$ (V/M), resulting in emission of electrons from the emitters E being started. This permits the anode current Ie to start to flow to the anode A. In general, a voltage $V_{OP}$ considerably higher than the threshold voltage $V_{TH}$ is kept applied between the gate and the cathode, during which the anode current $I_{OP}$ is permitted to flow to the anode A.

The anode current obtained from one conical emitter E is as low as about 1 $\mu$A, so that arraying of a number of emitters E permits the FEC to provide an anode current of a desired level.

Thus, when phosphors are arranged on the anode, the phosphor on a portion of the anode by which electrons field-emitted from the emitters is captured is permitted to emit light due to impingement of the electrons thereon. This results in an image display device or FED display device which has the FECs incorporated therein being realized.

Figure 1:
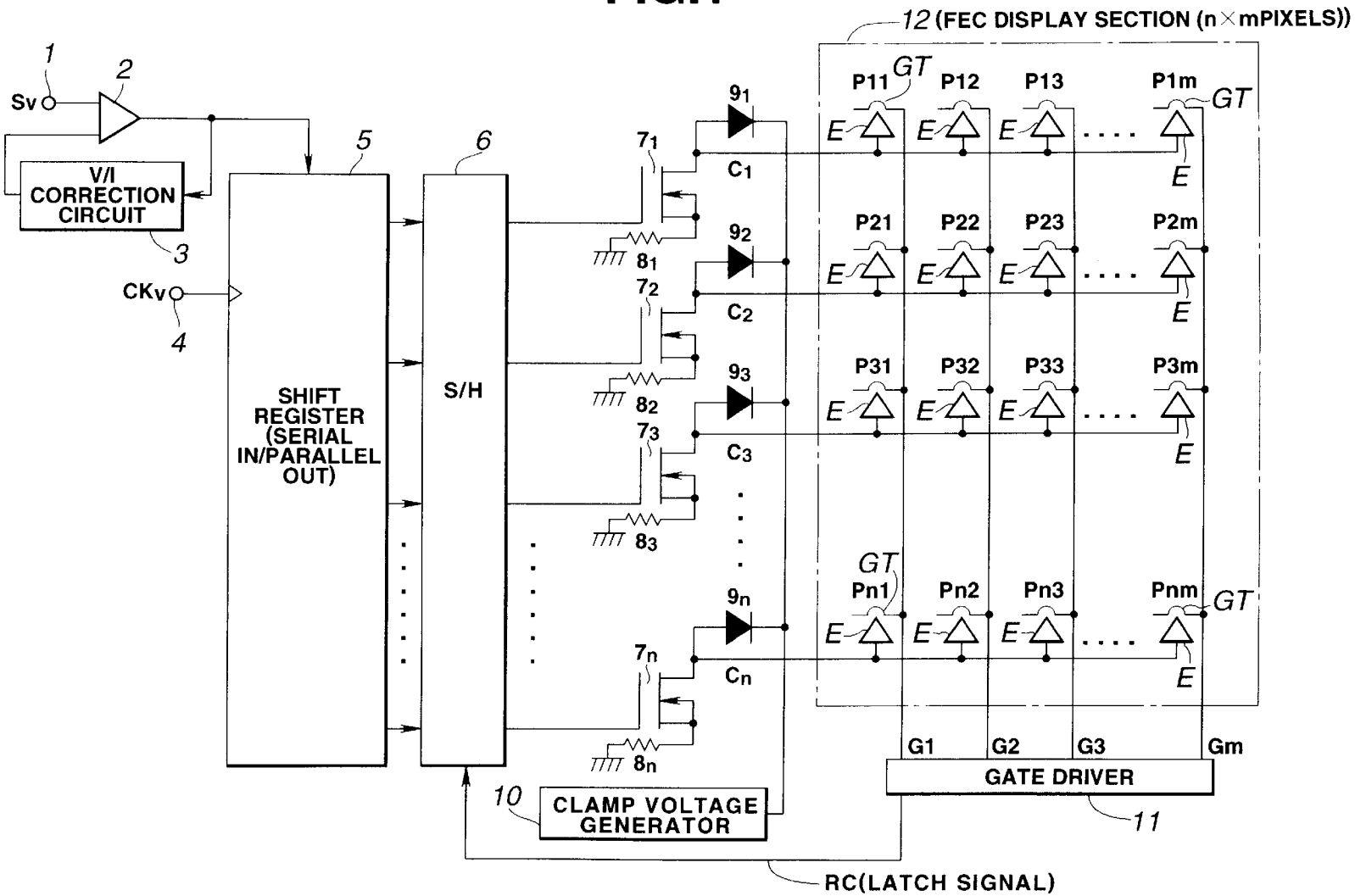
FIG. 1 is a block diagram showing an embodiment of a display device according to the present invention, which is in the form of an FED display device.

Referring now to FIG. 1, the FED display device thus realized is illustrated. The FED display device includes an FEC display section 12 which carries out display on the basis of such a principle as described above with reference to FIG. 4. In the FEC display section 12, a predetermined number of emitters E and the gate GT cooperate with each other to form a picture cell or pixel of one unit. Thus, the FEC display section 12 includes a display region having n×m pixels formed thereon, wherein pixels P11 to Pnm are arranged in a matrix-like manner. FIG. 4 shows a part of the emitters E which provide each one pixel, thus, the number of emitters E required for forming each one pixel is larger than that shown in FIG. 4.

The gate GT includes gate electrodes G1 to G*m* of m in number arranged in a vertical direction for every one horizontal line. The gate electrodes G1 to G*m* thus arranged are scanned in order for every one horizontal line period, resulting in so-called vertical scanning of an image being executed.

The emitters E are connected to cathode electrodes C1 to C*n* for every arrangement thereof in a vertical direction.

Therefore, for a period of time during which the gate electrode G1 is kept turned on, the cathode electrodes C1 to C*n* are fed with a signal depending on each of the picture cells constituting one horizontal line, so that field emission of electrons from the pixels P11, P21, - - - , P*n*1 may be carried out. The electrons are captured by the anode A, to thereby be impinged on the phosphor, leading to luminescence of the phosphor. Thus, luminescence of one line constituting an image is carried out. Subsequently, the gate electrodes G2, G3, - - - , G*m* are turned on in order for every horizontal period, during which the cathode electrodes C1 to C*n* are fed with a signal corresponding to a video signal, resulting in image display for one plane being executed.

An input terminal 1 is fed thereto with a video signal Sv, which is then amplified by a video amplifier 2 and fed to a shift register 5. The output of the video amplifier 2 is also fed to a V/I connection circuit 3, which carries out predetermined characteristics correction processing for the video signal Sv and the video signal Sv thus processed is then feedbacked to the video amplifier 2.

The shift register 5 may be constructed in the form of an analog shift register using a charge coupled device (CCD) and functions to subject an analog video signal in the form of serial input to shift operation based on a video clock CKv fed to a terminal 4. Then, the shift register 5 outputs the video signal Sv in the form of parallel output to a sample hold circuit 6 for every one horizontal line of the video signal Sv. Thus, video signals constituting picture cells for one horizontal line are concurrently fed to the sample hold circuit 6 for every one horizontal line timing and a value of a voltage sampled by the sample hold circuit 6 is hold-outputted during a period of the one horizontal line.

An operation frequency of the shift register 5, when a pixel size as picture cells for display is, for example, 240×320 pixels, is set to be 460 kHz to 920 kHz at 240×320×(60 to 120 frames). Also, when the size is, for example, 480×640 pixels, the frequency is set to be 18.4 MHz to 36.8 Mfz at 480×640×(60 to 120 frames). Further, when the size is, for example, 1024×768 pixels, it is set to be 47.1 MHz at 1024×768×(60 frames). (In the case of full color display, it is three times as high as the frequency.) In such a case, it is required to arrange a plurality of such shift registers 5.

The sample hold circuit 6 is fed with a latch signal RC from a gate driver 11 for carrying out vertical scanning for image display, so that reloading of the video signal for the one horizontal line is carried out for every period defined by the latch signal RC or for every one horizontal line period. The sample hold circuit 6 may be constructed in the form of a so-called analog latch circuit. For example, it may be constructed of an output circuit of a CCD, an analog switch and a capacitor. In this instance, it is merely required that outputting of a voltage of 90% or more based on an initial value thereof is ensured during an ON period of the gate driver 11 (latch period: 30 to 60 $\mu$sec).

The gate driver 11, as described above, is adapted to carry out vertical scanning for turning on the gate electrodes G1 to G*m* in order. For this purpose, it is constructed of a ring counter of m bits identical in number with the horizontal lines and a high-voltage push-pull output circuit (80 to 150 V). The high-voltage push-pull output circuit applies a voltage to the gate electrode selected depending on a value counted by the ring counter, to thereby turn on the gate electrode selected. Also, the gate driver 11 feeds the latch signal to the sample hold circuit 6 every time when one horizontal line period terminates, to thereby execute hold outputting of a video signal of the next horizontal line and shifts the ring counter by one bit, to thereby turn on the next gate electrode.

The hold output voltage thus generated from the sample hold circuit 6 is the applied to a gate of each of field effect transistors or FETs $\mathbf{7}_1$ to 7*n* of the MOS type. Also, a drain current of the MOS type FETs $\mathbf{7}_1$ to 7*n* is fed in the form of a drive current to the cathode electrodes C1 to C*n*. The MOS type FETs $\mathbf{7}_1$ to 7*n* each preferably include an insulation gate so that the hold output of the sample hold circuit 6 may be held without any variation within the one horizontal period.

It is known in the art that drain/source voltage $V_{DS}$-drain current $I_D$ characteristics of an FET element are generally constant-current characteristics as shown in FIG. 2. The illustrated embodiment utilizes such constant-current characteristics of an FET to subject the cathode current to stepless modulation depending on the video signal.

For example, during an ON period of the gate electrode G1, a cathode current for the pixels P11, P21, - - - , P*n*1 is determined depending on a gate voltage of the MOS type FET $\mathbf{7}_1$ to 7*n* substantially irrespective of characteristics of the pixels. In general. gate/source voltage $V_{GS}$-drain current $I_D$ characteristics of a MOS type FET element are non-linear as shown in FIG. 3. Thus, application of characteristics reverse to the characteristics to the video signal Sv acting as the gate voltage provides a cathode current linearly modulated in a stepless manner depending on a voltage value of the video signal Sv inputted to the input terminal 1. Thus, processing of characteristics of the video signal Sv is carried out in the V/I correction circuit 3 and video amplifier 2. The gate/cathode voltage $V_{GC}$-anode current Ie characteristics of each of the pixels in the FEC display section 12, as described above, are as shown in FIG. 5, wherein it is supposed that maximum luminance is set at $V_{OP}$ and $I_{OP}$. A gain of the video amplifier 2 is so adjusted that the drain/source voltage of the MOS type FETs $\mathbf{7}_1$ to 7*n* shown in FIG. 2 is forward of a curved point or between 1 V and 3 V. This permits a region of constant-current characteristics of the FET element to be utilized.

The V/I correction circuit 3 subjects the video signal Sv to, for example, logarithmic compression processing to provide it with characteristics reverse to the gate/source voltage $V_{GS}$-drain current $I_D$ characteristics of the FET element and feeds the thus processed video signal Sv to the gate of each of the MOS type FETs $\mathbf{7}_1$ to 7*n*.

This permits a current fed to the cathode electrodes C1 to C*n* to have characteristics linear to a voltage value of the video signal inputted to the input terminal 1, resulting in a cathode current linearly modulated in a stepless manner depending on the video signal Sv being provided.

Luminance of the FED display section 12 is proportional to the anode power. The anode voltage is generally rendered constant, so that the luminance is proportional to the anode current, which is substantially equal to the cathode current.

Also, the threshold voltage $V_{TH}$, and curve in the FET characteristics as shown in FIG. 5 are varied depending on the pixels, wherein a reduction in cathode current leads to a decrease in voltage drop of source resistors $\mathbf{8}_1$ to 8*n* connected to the sources of the MOS type FETs $\mathbf{7}_1$ to 7*n*, to thereby increase the gate/source voltage $V_{GS}$ of the MOS type FETs. When the cathode current is increased, operation contrary to the above-described operation is carried out. This results in the cathode current being increased, so that the MOS type FETs $\mathbf{7}_1$ to 7*n* feed a cathode current determined depending on the gate voltage.

A variation in cathode current causes a variation in luminance correspondingly. Thus, in the illustrated embodiment, the cathode current modulated in a stepless manner depending on the video signal Sv permits stepless gradation expression to be realized depending on the video signal Sv. This results in quality of an image displayed being highly improved, because it eliminates stepwise gradation as seen in the conventional PWM modulation and any affection due to a variation in characteristics shown in FIG. 5.

The display device of the illustrated embodiment further includes diodes $\mathbf{9}_1$ to 9*n* and a clamp voltage generation circuit 10, which are arranged so as to carry out clamp operation for protection of the FETs $\mathbf{7}_1$ to 7*n*. When a clamp voltage generated from the circuit 10 is not lower than a maximum rated voltage of the FET element and higher than $V_{OP}$–$V_{TH}$ of FIG. 5, leakage luminescence is caused. Also, the source resistors $\mathbf{8}_1$ to 8*n* of the FETs $\mathbf{7}_1$ to 7*n* function to correct a variation in characteristics of the MOS type FETs $\mathbf{7}_1$ to 7*n* as described above.

Alternatively, when processing by the V/I correction circuit 3 is insufficient for correction of the characteristics, a correction circuit system for A/D conversion of the video signal Sv, operation of the correction and D/A conversion thereof may be provided, to thereby carry out the correction by digital operation. In such a case, correction of the characteristics may be carried out for each of the FETs $\mathbf{7}_1$ to 7*n* and each of the pixels. Also, when correction of the characteristics is carried out for every FET by digital operation correction. arrangement of the above-described source resistors $8_1$ to 8*n* for correction of a variation in characteristics is eliminated. Also, correction of characteristics of the video signal Sv may be executed on the basis of characteristics of the pixels P11 to P*nm* previously stored In the form of table data in a memory.

Figure 6:
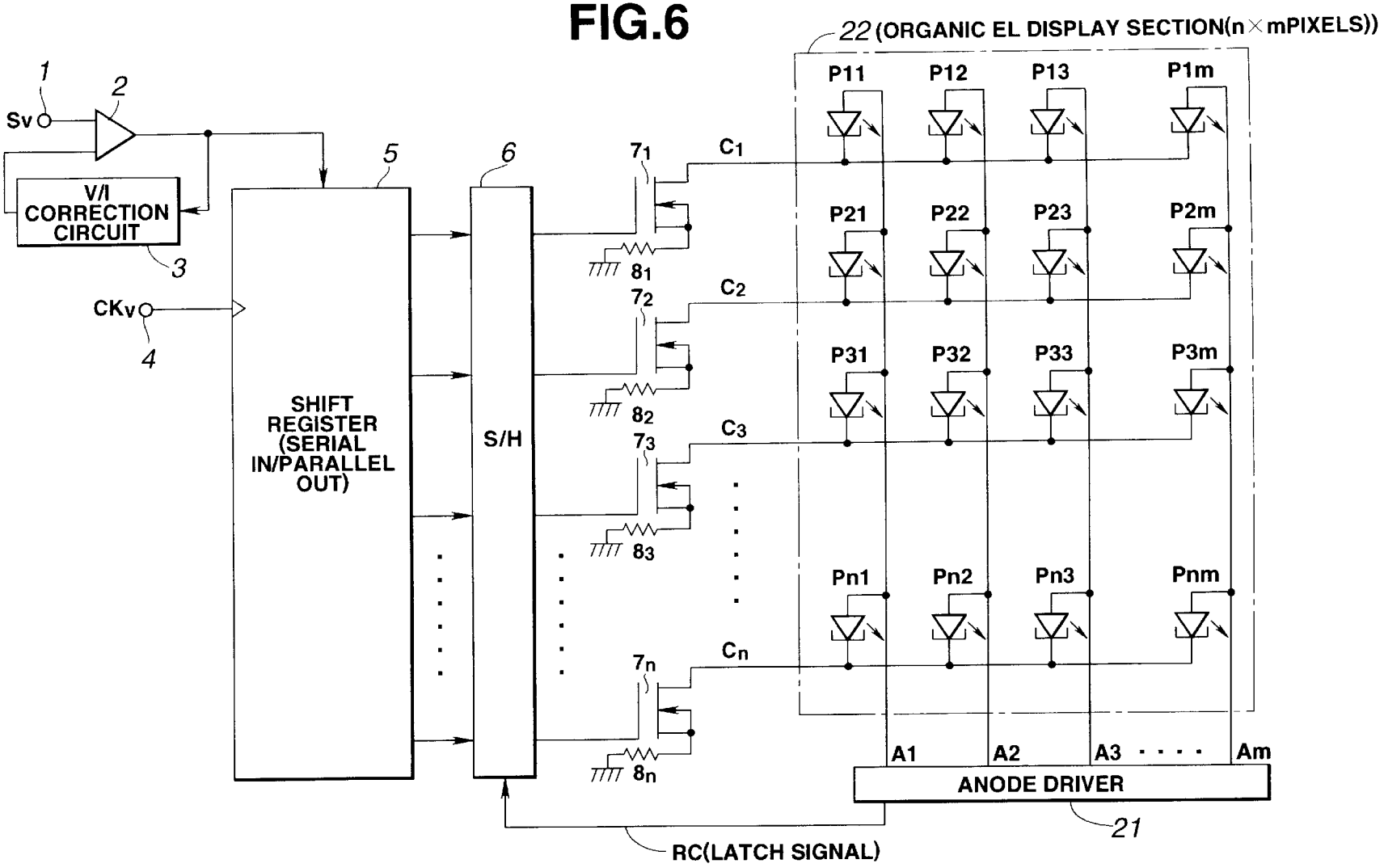
FIG. 6 is a block diagram showing another embodiment of a display device according to the present invention, which is in the form of an organic EL display device.
Figure 7:
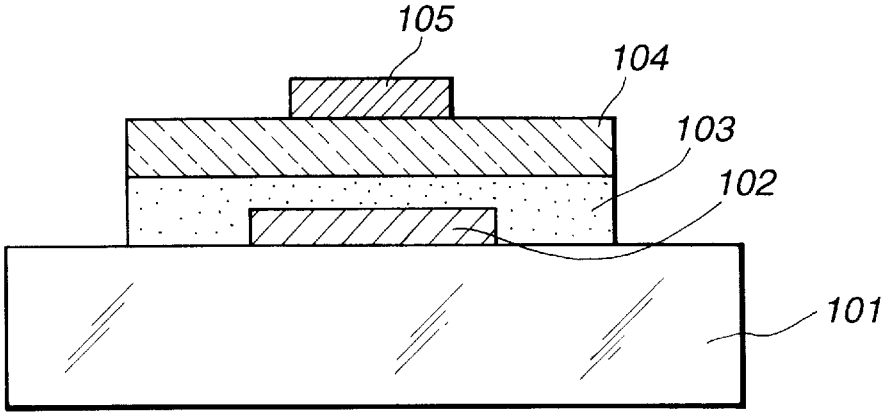
FIG. 7 is a schematic sectional view showing an organic EL display section.
Figure 8:
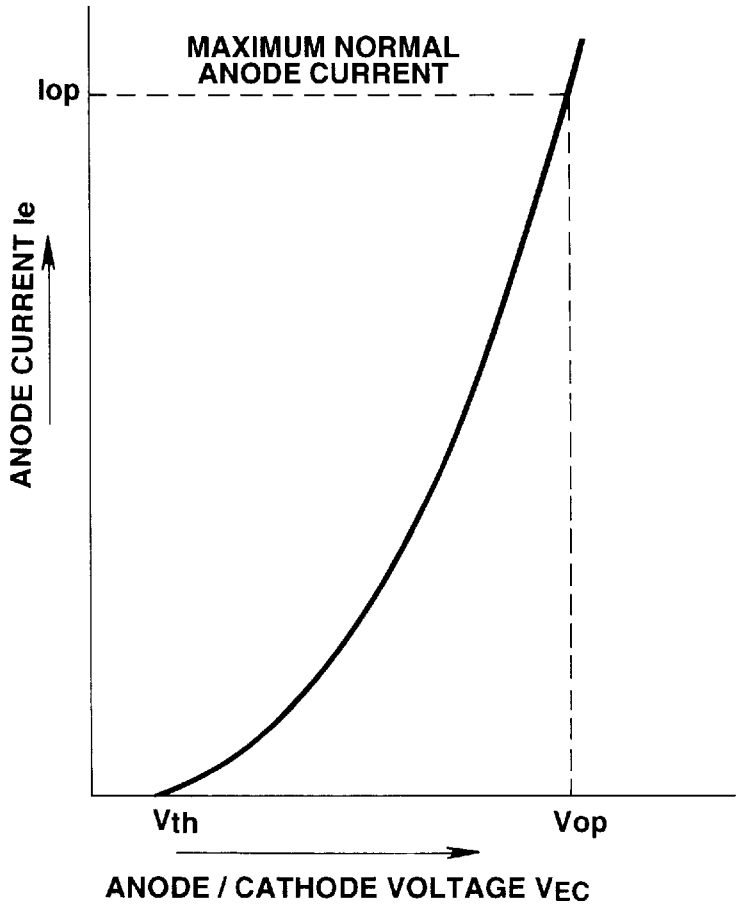
FIG. 8 is a graphical representation showing $V_{EC}$-$I_D$ characteristics of an organic EL display section.

Referring now to FIGS. 6 to 8, another embodiment of a display device according to the present invention is illustrated, which is in the form of an organic EL display device. An organic EL luminous element used for an organic EL display device of the illustrated embodiment may be constructed as shown in FIG. 7. The organic EL luminous element includes a glass substrate 101, a transparent ITO electrode 102 formed in the form of a thin film on the glass substrate 101, a hole transport layer 103 arranged on the substrate 101 so as to cover the ITO electrode 102, a luminous layer 104 arranged in a manner like a thin film on the hole transport layer 103 and an upper electrode 105 arranged on the luminous layer 104.

In the organic EL luminous element thus constructed, the upper electrode 105 acts as a cathode electrode and the ITO electrode 102 acts as an anode electrode. When a negative DC voltage and a positive DC voltage are respectively applied to the upper electrode 105 and ITO electrode 102, holes charged from the ITO electrode 102 are transported through the hole transport layer 103 and injected into the luminous layer 104. Also, electrons are injected from the upper electrode 105 into the luminous layer 104. The thus-injected holes and electrons are recombined together in the luminous layer 104. The recombination leads to luminescence of the luminous layer 104, which is then observed through the light-permeable hole transport layer 103, ITO electrode 102 and glass substrate 101. The luminescence may be obtained in an amount of 1000 (cd/cm2) at a DC voltage of 10 volts or less.

The hole transport layer 103 may be formed of triphenyl diamine (TPD) and the luminous layer 104 may be formed of an aluminum-quinolinol complex ($Alq_3$). Also, a luminous layer of a single-layer structure made of a luminous polymer may be substituted for the organic EL medium constructed of the hole transport layer 103 and luminous layer 104.

The organic EL display device utilizing a luminous principle of such an EL luminous element may be constructed by arranging a plurality of the lower electrodes or ITO electrodes 102 in a stripe-like mannor and arranging a plurality of the upper electrodes 105 in a stripe-like manner on the stripe-like ITO electrodes 102, to thereby form a matrix by cooperation of the electrodes 102 and 105 with each other. This permits cathode electrodes and anode electrodes to be arranged in a matrix-like manner. The thus-defined matrix is scanned by a drive circuit to control luminescence of picture cells formed at intersections of the matrix by means of an image signal in order, resulting in an image being displayed.

The organic EL display device thus constructed is shown in FIG. 6. More particularly. the organic EL display device includes an organic EL display section 22 which provides a display region. The organic EL display section 22 includes cathode electrodes C1 to C*n* (upper electrodes 105 in FIG. 7) and anode electrodes A1 to A*m* (ITO electrodes 102 in FIG. 7) arranged in a matrix-like manner, to thereby provide pixels P11 to P*nm* of n×m in number each acting as a luminous picture cell.

The anode electrodes A1 to A*m* are turned on in order for every one horizontal line period by the anode drivers 21, resulting in so-called vertical scanning of an image being executed. Also, a cathode current depending on a signal voltage of each of the picture cells constituting one horizontal line is fed to the cathode electrodes C1 to C*n* for each horizontal line period, leading to execution of image display.

For example, the cathode electrodes C1 to C*n* are fed with a signal depending on each of the picture cells constituting one horizontal line of the video signal for a period of time during which the anode electrode Al is kept turned on, resulting in luminous operation of the pixels P11, P21, P31, - - - , P*n*1 being executed. Thus, luminescence of one line constituting an image is executed. Then, the anode electrodes A2, A3, - - - , A*m* are turned on in order for every horizontal period and the cathode electrodes C1 to C*n* are fed with a signal depending on a video signal corresponding to the horizontal period, resulting in display for an image for one plane being executed.

An input terminal 1 is fed thereto with a video signal Sv, which is then amplified by a video amplifier 2 and fed to a shift register 5. The output of the video amplifier 2 is also fed to a V/I connection circuit 3, which carries out predetermined characteristics correction processing for the video signal Sv and the video signal Sv thus processed is then feedbacked to the video amplifier 2.

The video amplifier 2, the V/I correction circuit 3. the shift register 5 and a sample hold circuit 6 may be constructed and operated in substantially the same manner as those of the embodiment described above. Thus, the video signal Sv of the video amplifier 2 is serially inputted to the shift register 5, which subjects it to shift operation based on a video clock CKv, to thereby output the video signal Sv in the form of parallel output to the sample hold circuit 6 for every one horizontal line of the video signal Sv. Then, a voltage value of a video signal constituting each of picture cells for one horizontal line is hold-outputted during a period of the one horizontal line. The hold output of the sample hold circuit 6 is carried out on the basis of a latch signal RC from the anode driver 21 for carrying out vertical scanning for image display.

The anode driver 21 is adapted to turn on the anode electrodes A1 to A*m* in order for vertical scanning like the gate driver 11 described above with reference to FIG. 1. For this purpose, it is constructed of a ring counter of m bits identical in number with the horizontal lines and a high-voltage push-pull output circuit (5 to 30 V). The high-voltage push-pull output circuit applies a voltage to the anode electrode selected depending on a value counted by the ring counter, to thereby turn on the anode electrode selected. Also, the anode driver 21 feeds the latch signal RC to the sample hold circuit 6 every time when one horizontal line period terminates, to thereby execute hold outputting of a video signal for the next horizontal line and shifts the ring counter by one bit, to thereby turn on the next anode electrode.

In the illustrated embodiment as well as the above-described embodiment, the hold output voltage thus generated from the sample hold circuit 6 is applied to a gate of each of FETs $7_1$ to 7*n* of the MOS type. Also, a drain current of the MOS type FETs $7_1$ to 7*n* is fed in the form of a drive current to the cathode electrodes C1 to C*n*.

The illustrated embodiment utilizes such constant-current characteristics of the FET as shown in FIG. 2 to subject the cathode current to stepless modulation depending on the video signal, like the above-described embodiment.

The gate/cathode voltage $V_{GC}$-anode current Ie characteristics of each of the pixels in the organic EL display section 22 are as shown in FIG. 8, wherein it is supposed that maximum luminance is set at $V_{OP\ and\ IOP}$. In this Instance, a gain of the video amplifier 2 is so adjusted that the drain/source voltage $V_{DS}$ of the MOS type FETs $\mathbf{7}_1$ to $\mathbf{7}n$ shown in FIG. 2 is forward of a curved point or between 1 V and 3 V.

The V/I correction circuit 3 subjects the video signal Sv to, for example, logarithmic compression processing to provide it with characteristics reverse to the gate/source voltage $V_{GS}$-drain current $I_D$ characteristics of the FET element shown in FIG. 3 and feeds the thus-processed video signal Sv to the gate of each of the MOS type FETs $\mathbf{7}_{1\ to\ 7}n$.

This permits a current fed to the cathode electrodes C1 to C*n* to have characteristics linear to a voltage value of the video signal inputted to the input terminal 1, resulting in a cathode current linearly modulated in a stepless manner depending on the video signal Sv being provided.

Luminance of the organic EL display section 22 is proportional to the anode power. Thus, supposing that the anode voltage is rendered constant, the luminance is proportional to the anode current, which is substantially equal to the cathode current.

Also, the threshold voltage $V_{TH}$ and curve in the FET characteristics at such abode current characteristics of the organic EL display section 22 as shown in FIG. 8 are varied depending on the pixels, wherein a reduction in cathode current leads to a decrease in voltage drop of source resistors $\mathbf{8}_1$ to $\mathbf{8}n$ connected to the sources of the MOS type FETs $\mathbf{7}_1$ to $\mathbf{7}n$, to thereby increase the gate/source voltage $V_{GS}$ of the MOS type FETS. When the cathode current is increased, operation contrary to the above-described operation is carried out. This results in the cathode current being increased, so that the MOS type FETs $\mathbf{7}_1$ to $\mathbf{7}n$ feed a cathode current determined depending on the gate voltage.

A variation in cathode current causes a variation in luminance correspondingly. Thus, in the illustrated embodiment as well, the cathode current modulated In a stepless manner depending on the video signal Sv permits stepless gradation expression to be realized depending on the video signal Sv. This results in quality of an image displayed being highly improved, because it eliminates such stepwise gradation as seen in the conventional PWM modulation and any affection due to a variation in characteristics shown in FIGURE 8.

In the illustrated embodiment as well, the source resistors $\mathbf{8}_1$ to $\mathbf{8}n$ of the FETs $\mathbf{7}_1$ to $\mathbf{7}n$ function to correct a variation in characteristics of the MOS type FETs $\mathbf{7}_1$ to $\mathbf{7}n$.

Also, in the illustrated embodiment as well, when processing by the V/I correction circuit 3 is insufficient for correction of the characteristics, a correction circuit system for A/D conversion of the video signal Sv, operation of the correction and D/A conversion thereof may be provided, to thereby carry out the correction by digital operation. Also, when correction of the characteristics is carried out for every FET by digital operation correction, arrangement of the above-described source resistors $\mathbf{8}_1$ to $\mathbf{8}n$ for correction of a variation in characteristics is eliminated. In addition, correction of characteristics of the video signal Sv may be executed on the basis of characteristics of the pixels P11 to P*nm* previously stored in the form of table data in a memory.

As can be seen from the foregoing, the display device of the present invention is so constructed that the FET element is arranged for each of the cathode electrodes to permit the drain current obtained depending on the voltage of the video signal applied to the gate of each FET element to be fed to each of the cathode electrodes. Also, the present invention includes the video signal correction circuit for providing the video signal applied to each FET element with characteristics reverse to the gate/source voltage-drain current characteristics of the FET element. Such construction permits the cathode current to be controlled in a stepless manner depending on a level of the video signal to thereby realize stepless gradation expression depending on the video signal, resulting in quality of an image displayed being extensively increased.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A display device comprising:

an FED display section which includes a plurality of cathode electrodes each formed into a stripe-like manner and including emitters for field emission of electrons, a plurality of gate electrodes formed in a stripe-like manner and arranged in a direction perpendicular to said cathode electrodes, and an anode electrode for capturing electrons emitted from said emitters, resulting in display pixels being defined in a matrix-like manner;

a display drive circuit for driving said gate electrodes in order and driving said cathode electrodes depending on a video signal for every horizontal line, to thereby permit said FED display section to execute image display;

said display drive circuit including an FET element arranged for each of said cathode electrodes and being so constructed that a drain current obtained depending on a voltage of the video signal applied to a gate of each of said FET elements may be fed in the form of a drive current to each of said cathode electrodes.

2. A display device as defined in claim 1, further comprising a video signal correction circuit for providing said video signal applied to said FET elements with characteristics reverse to gate/source voltage-draln current characteristics of said FET elements.

3. A display device as defined in claim 2, wherein said video signal correction circuit corrects characteristics of said video signal applied to each of said FET elements with respect to non-linear characteristics of said FED display section as well.

* * * * *

UNITED STATES PATENT AND TRADEMARK OFFICE

CERTIFICATE OF CORRECTION

PATENT NO. : 6,091,381

DATED : July 18, 2000

INVENTOR(S): Mitsuo UENUMA

It is certified that an error appears in the above-identified patent and that said Letters Patent is hereby corrected as shown below:

On the title page, item [30] has been omitted. The Foreign Application Priority Data should read as follows:

--[30] Foreign Application Priority Data

Apr. 24, 1996 [JP] Japan.....8-126288--

Signed and Sealed this

Seventeenth Day of April, 2001

*Attest:*

Nicholas P. Godici

NICHOLAS P. GODICI

*Attesting Officer*

*Acting Director of the United States Patent and Trademark Office*